US006876329B2

(12) United States Patent
Milosavljevic

(10) Patent No.: US 6,876,329 B2
(45) Date of Patent: Apr. 5, 2005

(54) ADJUSTABLE PLANAR ANTENNA

(75) Inventor: Zlatoljub Milosavljevic, Oulu (FI)

(73) Assignee: Filtronic LK Oy, Kempele (FI)

( * ) Notice: Subject to any disclaimer, the term of this patent is extended or adjusted under 35 U.S.C. 154(b) by 52 days.

(21) Appl. No.: 10/646,433

(22) Filed: Aug. 22, 2003

(65) Prior Publication Data

US 2004/0041733 A1 Mar. 4, 2004

(30) Foreign Application Priority Data

Aug. 30, 2002 (FI) ..... 20021555

(51) Int. Cl.[7] ..... H01Q 1/38
(52) U.S. Cl. ..... 343/700 MS; 343/702; 343/876
(58) Field of Search ..... 343/700 MS, 702, 343/846, 848, 876

(56) References Cited

U.S. PATENT DOCUMENTS

| | | | | |
|---|---|---|---|---|
| 5,585,810 | A | 12/1996 | Tsuru et al. | |
| 5,764,190 | A | 6/1998 | Murch et al. | |
| 6,034,636 | A * | 3/2000 | Saitoh | 343/700 MS |
| 6,034,638 | A | 3/2000 | Thiel et al. | |
| 6,255,994 | B1 | 7/2001 | Saito | |
| 6,680,705 | B2 * | 1/2004 | Tan et al. | 343/702 |
| 6,693,594 | B2 * | 2/2004 | Pankinaho et al. | 343/700 MS |

FOREIGN PATENT DOCUMENTS

| | | | |
|---|---|---|---|
| EP | 1 052 723 | A2 | 11/2000 |
| EP | 1 113 524 | A2 | 7/2001 |
| EP | 0 687 030 | B1 | 9/2001 |
| JP | 8-242118 | A1 | 9/1996 |
| WO | WO-01/29927 | A1 | 4/2001 |
| WO | WO-01/91233 | A1 | 11/2001 |
| WO | WO-02/078124 | A1 | 10/2002 |

OTHER PUBLICATIONS

Patent Abstracts of Japan, Publication No. 11136025, published May 21, 1999, Murata Mfg. Co., Ltd., Abstract.

* cited by examiner

*Primary Examiner*—Shih-Chao Chen
(74) *Attorney, Agent, or Firm*—Darby & Darby

(57) ABSTRACT

An adjustable planar antenna especially applicable to mobile terminals, and to a radio device provided with that kind of antenna. The basic structure of the antenna is PIFA. On a surface of a dielectric part (205) there is placed a strip conductor (230) so that this has a significant electromagnetic coupling to the radiating plane (220). The strip conductor can be connected by a switch (SW) to the ground plane. When the switch is closed, the electric length of the radiating plane is changed, measured from the short point (S). In which case also the antenna's resonance frequency is changed. The change depends on the place and the size of the strip conductor. In the case of a multi-band antenna the strip conductor can be placed so that it has a remarkable electromagnetic coupling to one or more radiating elements (B1, 226). The adjusting of planar antenna is performed by means of small additive components, which do not presume changes in the antenna's basic structure and do not enlarge the antenna.

12 Claims, 4 Drawing Sheets

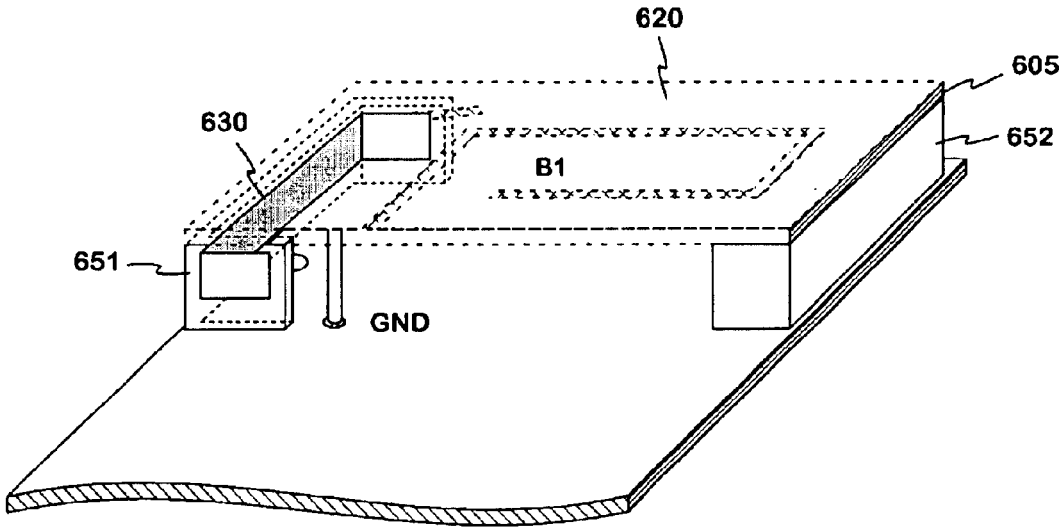
Fig. 6
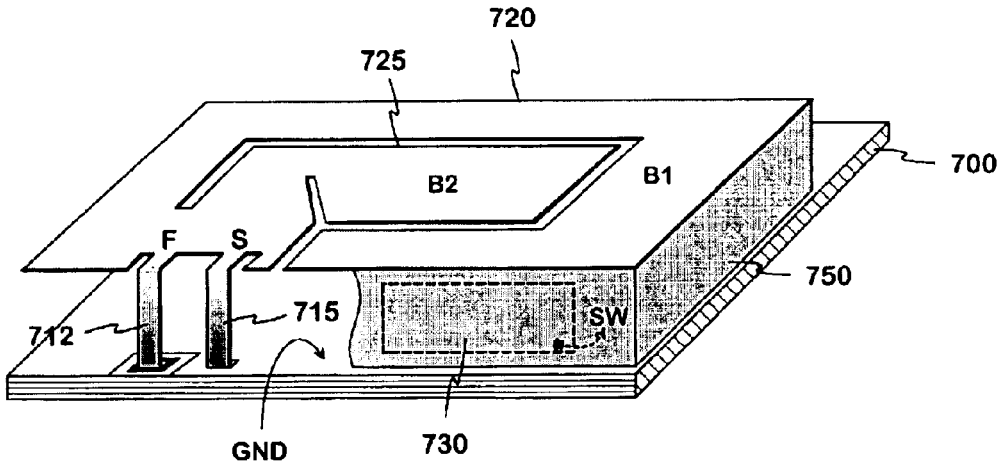
Fig. 7
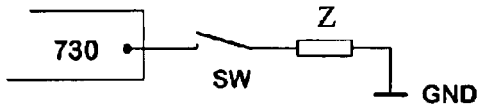

ADJUSTABLE PLANAR ANTENNA

The invention relates to an adjustable planar antenna especially applicable in mobile terminals. The invention further relates to a radio device employing that kind of antenna.

BACKGROUND OF THE INVENTION

In portable radio devices, mobile terminals in particular, the antenna is preferably placed inside the covers of the device for convenience. The internal antenna of a small device is usually of planar-type, because satisfactory electric characteristics are then most easily achieved for the antenna. The planar antenna comprises a radiating plane and a ground plane parallel therewith. As mobile terminals are becoming smaller thickness-wise, too, the distance between the radiating plane and the ground plane of a planar antenna should be as short as possible. However, a drawback of the reducing of said distance is that the bandwidth(s) of the antenna are becoming smaller. Then, as a mobile terminal is designed to function according to different systems having frequency ranges relatively close to each other, it becomes more difficult or impossible without special arrangements to cover said frequency ranges used by more than one radio system. Such a system pair is for instance GSM 1800 (Global System for Mobile telecommunications) and GSM 1900. Correspondingly, securing the function that conforms to specifications in both transmitting and receiving bands of a single system can become more difficult.

The above-described drawbacks are avoided, if a resonance frequency or resonance frequencies of the antenna can be changed electrically so that the operation band of the antenna round a resonance frequency always covers the frequency range, which the function presumes at a given time.

From publication JP 8242118 is known a solution for adjusting antenna's resonance frequency, such that at each side of the radiating plane there are openings extending from the edge of the plane towards the center area thereof. To each opening is connected an electronic switch which, when conducting, shorts the opening in question at a certain point. Changing the state of a switch changes electrical dimensions of the radiating plane and, thereby, the resonance frequency of the antenna. Each switch is controlled with a control signal of its own, so the antenna can be adjusted step by step. A drawback of this solution is that the effect of a single switch is minimal, and therefore many switches are needed. The number of switch components and mounting them causes remarkable extra cost.

From publications EP 0 687 030 and U.S. Pat. No. 5,585,810 is known a solution, in which between the radiating plane and the ground plane there is a capacitance diode and another capacitive element. Antenna's resonance frequency is changed by changing the capacitance of the diode by means of a control voltage via a control circuit. A drawback of this solution is that it complicates the basic structure of the antenna, in which case the manufacturing costs of the antenna are relatively high. This is emphasized in multi-band antennas, since separate arrangement is needed for each operation band.

From publication U.S. Pat. No. 6,255,994 is known a solution according to FIG. 1. There can be seen a rectangular radiating plane 2 and a ground plane 3. These planes are supported at a certain distance from each other by a dielectric block 14. At the one end of the antenna there are feed/receive conductor 4, first short conductor 5 and second short conductor 6, which conductors are joined galvanically to the radiating plane. The feed/receive conductor is isolated from the ground plane by a hole 3*a*, first short conductor by a hole 3*b* and second short conductor by a hole 3*c*. The first short conductor 5 can be connected to the ground plane through the first switch 7. This is a two-way switch, a terminal 7*a* of which can be connected to a terminal 7*b* or to terminal 7*c*. In the former case the first short conductor is connected to the ground plane through an inductive element 8 and in the latter case directly. Instead of an inductive element a capacitive element can be used or both of these can be used besides the direct connection. The second short conductor 6 can be connected to the ground plane through the second switch 9. This is a closing switch, a terminal 9*a* of which can be connected to a terminal 9*b*. In this case the second short conductor is connected directly to the ground plane. The state of the switch 7 is determined by the first control signal $S_{D1}$ coming from a controller 13, and the state of the switch 9 is determined by the second control signal $S_{D2}$ coming from the controller 13. The resonance frequency of the antenna structure is changed by controlling switches 7 and 9. In the case of two-state switches there are four alternative short-circuit arrangements and at the same time resonance frequencies. Three of these are used: The lowest frequency is obtained when the first short conductor is connected through the inductive element and the second short conductor is not at all connected. The higher frequency is obtained when the first short conductor is connected directly to the ground plane and the second short conductor is not at all connected. The highest frequency is obtained when the first short conductor is connected through the inductive element and the second short conductor is connected directly to the ground plane. By dimensioning the radiating plane and the distances between the conductors joined to it, the spaces between the operation bands corresponding to three resonance frequencies can be determined.

A drawback of this solution is that when a multi-band antenna is needed, it is in practice difficult or impossible to match above-mentioned operation bands to the frequency ranges used by the systems at issue. Moreover the structure comprises, compared with an usual PIFA (planar inverted F-antenna), an additive short conductor with it's arrangements, resulting to extra size and manufacturing cost of the antenna.

SUMMARY OF THE INVENTION

An object of the invention is to alleviate the above-mentioned drawbacks associated with the prior art. An adjustable planar antenna according to the invention is characterized in that which is specified in the independent claim 1. A radio device according to the invention is characterized in that which is specified in the independent claim 12. Advantageous embodiments of the invention are presented in the dependent claims.

The basic idea of the invention is as follows: The basic structure of the antenna is PIFA having a fixed short conductor between the radiating plane and the ground plane. On a surface of a dielectric part, which belongs to the basic structure of the PIFA, there is placed a strip conductor having a significant electromagnetic coupling to the radiating plane. The strip conductor can be connected by a switch to the ground plane, directly galvanically or through a series element. When the switch is closed, the electric length of the radiating plane is changed, measured from the short point, in which case also the antenna's resonance frequency changes. In the case of a multi-band antenna the strip conductor can be placed so that it has a significant electromagnetic coupling to one or more radiating elements.

An advantage of the invention is that the adjusting of a PIFA-type planar antenna is performed by means of small additive components, which do not presume changes in the antenna's basic structure. Thereupon the antenna's size does not change and the extra cost of the adjustability is relatively low. Another advantage of the invention is that the effect of the strip conductor according to the invention can be directed as desired, for example to the lower or higher operation band of a dual-band antenna, or as well to both operation bands. A further advantage of the invention is that the growth in dissipations of the antenna, caused by the arrangement according to the invention, are relatively low.

BRIEF DESCRIPTION OF THE DRAWINGS

The invention is below described in detail. Reference will be made to the accompanying drawings where FIG. 6 shows a third example of a adjustable planar antenna according to the invention, FIG. 7 shows a fourth example of a adjustable planar antenna according to the invention.

DETAILED DESCRIPTION OF THE INVENTION

Figure 2A:
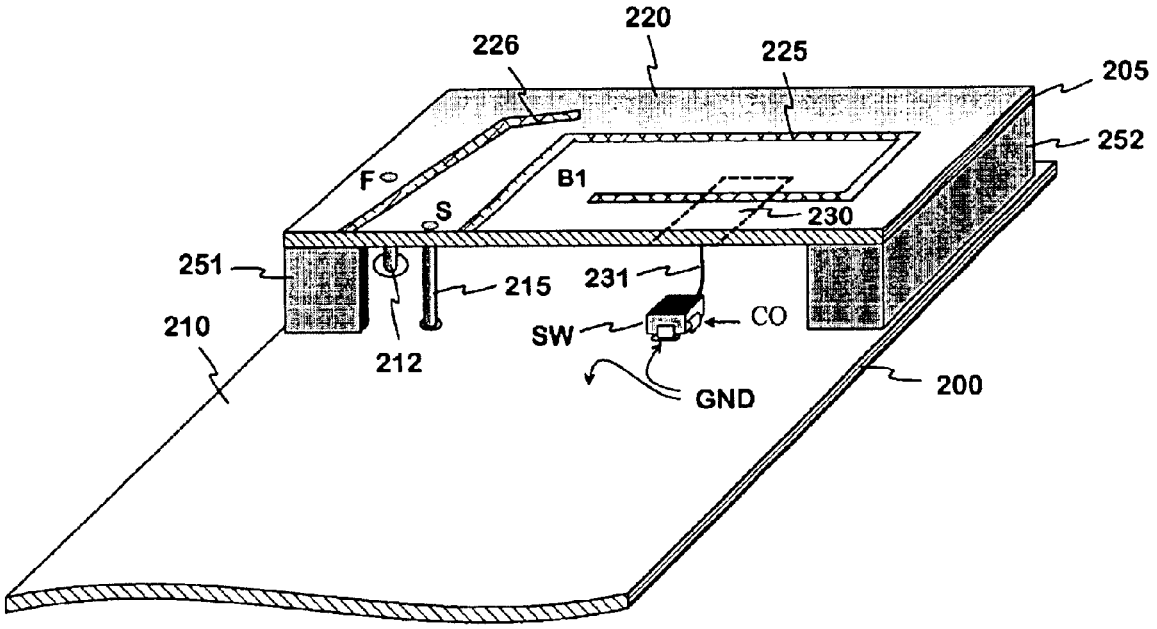
FIG. 2*a* shows an example of a adjustable planar antenna according to the invention.

FIGS. 2*a, b* show an example of a adjustable planar antenna according to the invention. In FIG. 2*a* there is seen a part of a circuit board 200 of a radio device, the antenna of which is in question. The upper surface of the radio device's circuit board is mostly conductive functioning as the ground plane 210 of the planar antenna and at the same time as the signal ground GND. Above the one end of the circuit board 200, at a height determined by dielectric pieces 251 and 252, there is a rectangular dielectric plate 205. On the upper surface of this plate there is the antenna's radiating plane 220. To the radiating plane is connected the antenna's feed conductor 212 at the feed point F and the short conductor 215 at the short point S. The short conductor connects the radiating plane galvanically to the ground plane to match the antenna's impedance. The antenna then is PIFA-type. In the radiating plane there is a first slot 225 starting from the one longer edge of the plate, on the outer side of the short point as viewed from the feed point. The first slot is formed so that the radiating plane has a conductive branch B1, which consists of, starting from the short point, a first portion parallel with the shorter side of the plate, a second portion parallel with the longer side and bounded by the second longer edge of the plate, a third portion parallel with the shorter side and bounded by the shorter edge of the plate, a fourth portion parallel with the longer side and bounded by the one longer edge of the plate, a fifth portion directing to the inner region of the plane and a sixth portion parallel with the longer side of the plate. The end of the branch B1, or the sixth portion, is then situated inside an U-figure formed by the second, the third and the fourth portion. In the radiating plane 220 there is also a second slot 226 starting from the same longer edge as the first slot and going between the feed point and the short point. The other end, or closed end, of the second slot is near the opposite longer side of the radiating plane.

In the example of FIG. 2*a* the antenna has two bands. The branch B1 together with the ground plane constitutes a resonator, the basic resonance frequency of which is in the lower operation band of the antenna. The second slot 226 together with the surrounding conductive plane and the ground plane constitutes a resonator, the basic resonance frequency of which is in the upper operation band of the antenna.

On the lower surface of the dielectric plate 205 there is, drawn by a broken line in FIG. 2*a*, a conductive element 230 according to the invention. In this example the conductive element is a rectangular strip conductor, which starts from the one longer edge of the plate by the fourth portion of the conductive branch B1 being on the upper surface of the plate, and extends by the sixth portion of the branch B1. The area of the strip conductor 230 is so large that it has a significant electromagnetic coupling to the radiating plane of the antenna, mainly to the conductive branch B1 because of said situation of the strip conductor. The strip conductor 230 can therefore be called a parasitic element. The term "parasitic" refers also in the claims to a structure part, which has a significant electromagnetic coupling to the radiating plane of the antenna.

Figure 2B:
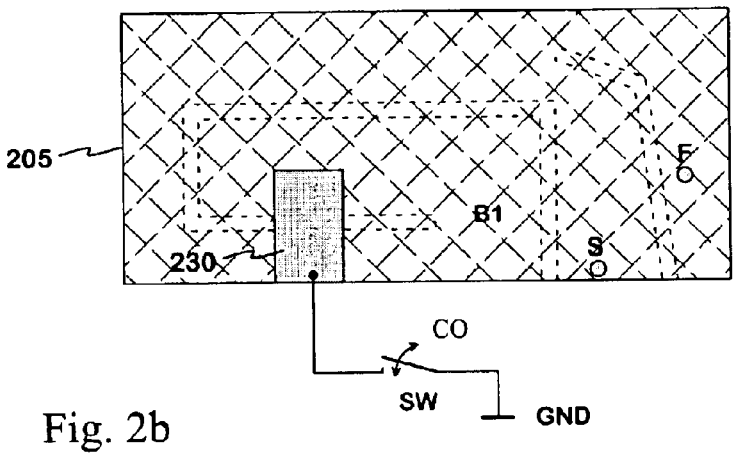
FIG. 2*b* shows the antenna circuit board of the planar antenna of FIG. 2*a*, seen underneath.

The strip conductor 230 is connected by the switch conductor 231 to the first terminal of the switch SW, which is placed on the circuit board 200 of the radio device. The second terminal of the switch SW is connected directly to the ground plane. The terminals of the switch can be connected to each other and separated from each other by a control signal CO. As the first terminal is connected to the second terminal, the strip conductor 230 is connected to the ground plane and from an intervening point on the radiating branch B1 there is a certain impedance to the signal ground, which impedance depends on the strength of the electromagnetic coupling. In this case the electromagnetic coupling is mainly capacitive, for which reason the electric length of the branch B1 is longer, and the corresponding resonance frequency of the antenna lower than without said connection. FIG. 2*b* shows the antenna circuit board, seen underneath. On the surface of the dielectric plate 205 there is the strip conductor 230. The slots and the branch B1 of the radiating plane are drawn by broken lines. The switch SW is presented by a graphic symbol. In practice the switch is e.g. a pin-diode or a field-effect transistor.

Figure 3:
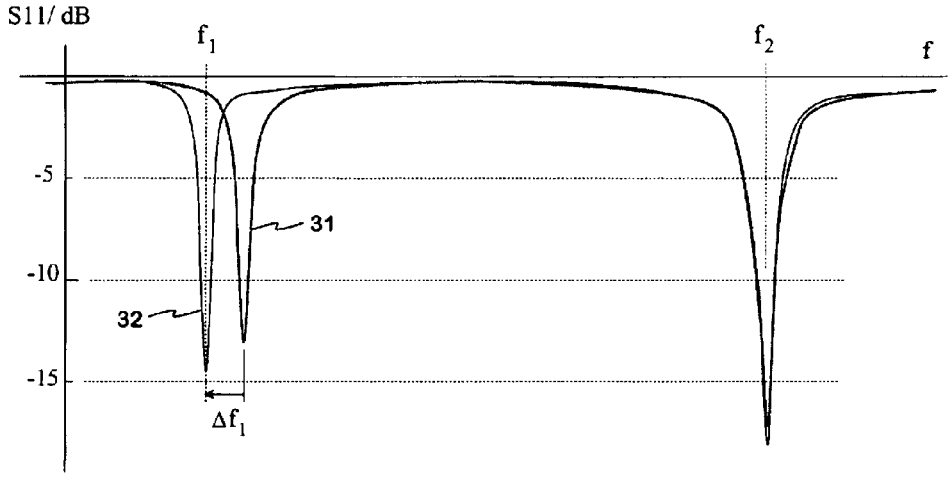
FIG. 3 shows the effect of the arrangement of FIG. 2*a* on antenna's operation bands.

FIG. 3 shows an example of the effect of the connection of parasitic strip conductor on antenna's operation bands in the structure according to FIG. 2*a*. In the FIG. 3 there are measuring results of the reflection coefficient S11 of the antenna. Curve 31 shows alteration of the reflection coefficient as a function of frequency, when the strip conductor is not connected to the ground, and curve 32 shows alteration of the reflection coefficient as a function of frequency, when the strip conductor is connected to the ground. When comparing the curves, it will be seen that the lower operation band is shifted downwards and the minimum value of the reflection coefficient slightly drops, or improves a bit at the same time. In this example a frequency $f_1$, or the centre frequency of the band for a start, is 950 MHz and the frequency displacement $\Delta f_1$, is about −80 MHz. The structure can easily be arranged so that the operation band covers either the receiving or the transmitting range of the GSM900 system depending on whether the switch SW is non-conductive or conductive. For the upper operation band, placed in a range of 2 GHz, changes caused by closing the switch are very small.

Figure 4:
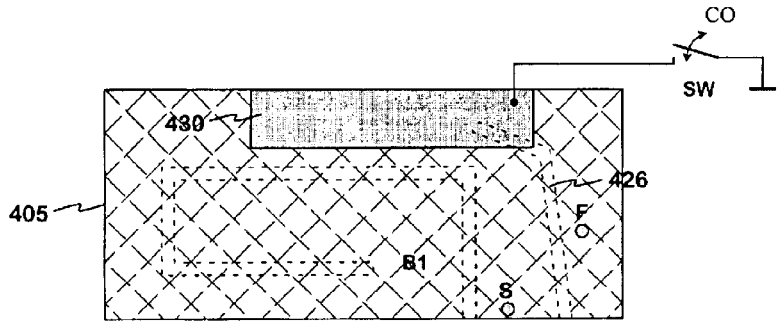
FIG. 4 shows a second example of a adjustable planar antenna according to the invention.

FIG. 4 shows a second example of a adjustable planar antenna according to the invention. The basic structure is similar as in FIG. 2*a*, the only difference relates to the place and size of the parasitic strip conductor. Then only the antenna circuit board is shown in FIG. 4, seen underneath. Compared with FIG. 2*b* the strip conductor 430 is now on the opposite longer side of the dielectric plate 405 so that it covers up for the most part of the second portion of the radiating branch B1. Additionally the strip conductor covers a part of the radiating slot 426 at the closed end of slot.

Figure 5:
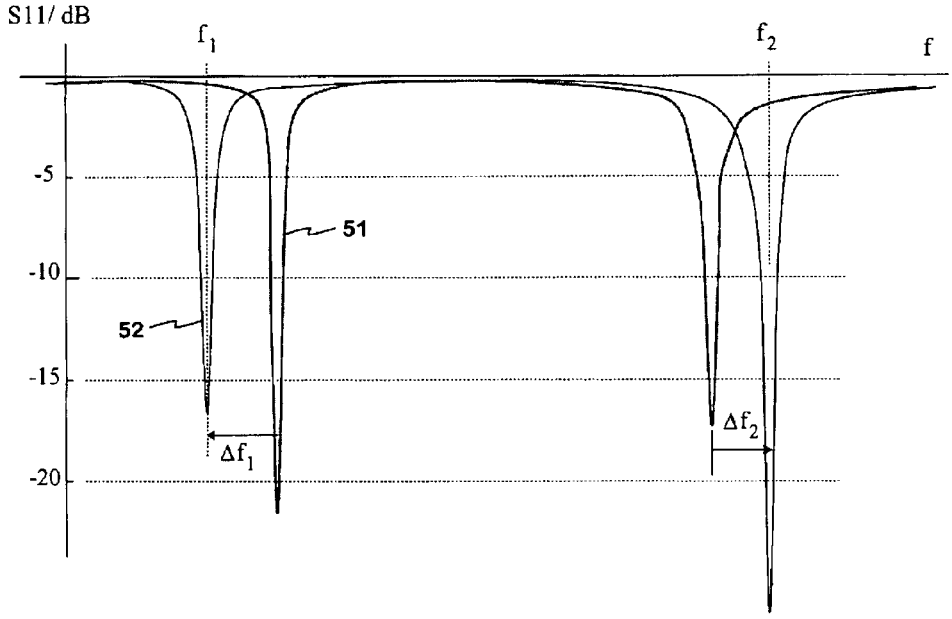
FIG. 5 shows the effect of the arrangement of FIG. 4 on antenna's operation bands.

FIG. 5 shows the effect of the connection of parasitic strip conductor on antenna's operation bands in an antenna corresponding to FIG. 4. Curve 51 shows alteration of the reflection coefficient S11 as a function of frequency, when the strip conductor is not connected to the ground, and curve 52 shows alteration of the reflection coefficient as a function of frequency, when the strip conductor is connected to the ground. When comparing the curves, it will be seen that the lower operation band is shifting downwards. The frequency $f_1$, or the centre frequency of the lower band for a start, is 950 MHz and it's displacement $\Delta f_1$ is about −140 MHz. The upper operation band, placed in a range of 2 GHz, is shifting upwards, and the minimum value of the reflection coefficient is in this case clearly improving at the same time. Shifting the band upwards results from that the strip conductor 430 causes additional capacitance in the end of the quarter wave resonator, where magnetic field prevails. The resonator at issue is based on the slot 426. Then the electric length of the slot radiator shortens and the resonance frequency rises. The displacement $\Delta f_2$ of the upper operation band is about 110 MHz in the example of FIG. 4.

FIG. 6 shows a third example of an adjustable planar antenna according to the invention. The basic structure is similar as in FIG. 2*a*. The difference is that the parasitic strip conductor 630 is now placed, instead of the antenna circuit board 605, on a vertical surface of a dielectric piece 651, which holds the antenna circuit board. In FIG. 6 the antenna circuit board is drawn transparent for illustrating the strip conductor better. The dielectric piece 651, shaped as a broad rectangular U, skirts that end of the planar antenna, in the vicinity of which the feed and the short conductor and the second, radiating slot are. The strip conductor 630 is attached on the inner surface of the dielectric piece 651. The strip conductor has in this example a portion, the length of which is the same as of the inner wall of the dielectric piece 651 parallel with the shorter side of the antenna circuit board. The strip conductor further consists of two shorter portions parallel with both longer sides of the antenna circuit board. The strip conductor 630 has in accordance with the invention only electromagnetic coupling to the radiating plane 620.

By means of the arrangement of FIG. 6 it is achieved, that the connection of the strip conductor to the ground effects on the upper operation band of the antenna, but not very much on the lower operation band. This is obvious on the grounds of the locations of the radiating second slot and the conductive branch B1. The upper operation band can be shifted upwards for example 60 MHz. A minor effect on the lower band is downwards shifting. If the strip conductor is placed in corresponding way on the surface of the second dielectric piece 652, locating in the opposite end of the antenna, the connection of the strip conductor to the ground naturally effects strongly on the lower operation band, whereas the effect on the upper operation band is insignificant.

FIG. 7 shows a fourth example of an adjustable planar antenna according to the invention. The basic structure of the PIFA deviates from structures of previous examples. The radiating plane 720 is now a quite rigid conductive plate, or metal sheet, which is supported to the circuit board 700 of a radio device by a dielectric frame 750. This is drawn only partly. The feed conductor 712 and the short conductor 715 are located on the one longer side of the radiating plane, close to one of the corners of the plane. Said conductors are of the spring contact type and constitute a single unitary piece with the radiating plane. When the radiating plane is installed, a spring force presses the contacts against the upper surface of the circuit board 700, the contact of the short conductor against the ground plane GND and the contact of the feed conductor against a contact surface isolated from the ground plane. In the radiating plane 720 there is a slot 725, which starts from the edge of the plane, close to the short point S, and ends up at the inner region of the plane. The shape of the slot 725 is such that the radiating plane is divided, viewed from the short point, to a first branch B1 and a second branch B2. The first branch B1 skirts along edges of the plane and surrounds the second, shorter branch B2. Then also this antenna has two bands. A parasitic strip conductor 730 according to the invention is attached or otherwise provided on a vertical inner surface of a dielectric frame 750, on that longer side of the antenna, where the feed conductor and the short conductor are located. The strip conductor 730 is in that case below the last portion of the first branch B1. For this reason the connection of the strip conductor effects in practice only on the place of the lower operation band of the antenna.

In the example of FIG. 7 the parasitic element is connected to a switch SW, the other terminal of which is instead of a plain conductor connected to the signal ground through a structure part having an impedance Z. The impedance Z can be utilized, if desired displacements of operation bands can not be obtained merely by selecting the place of the parasitic element. The impedance is either purely inductive or purely capacitive; a resistive part is out of the question due to dissipations caused by it. Naturally the impedance Z can be zero also in the structure of FIG. 7.

Figure 1:
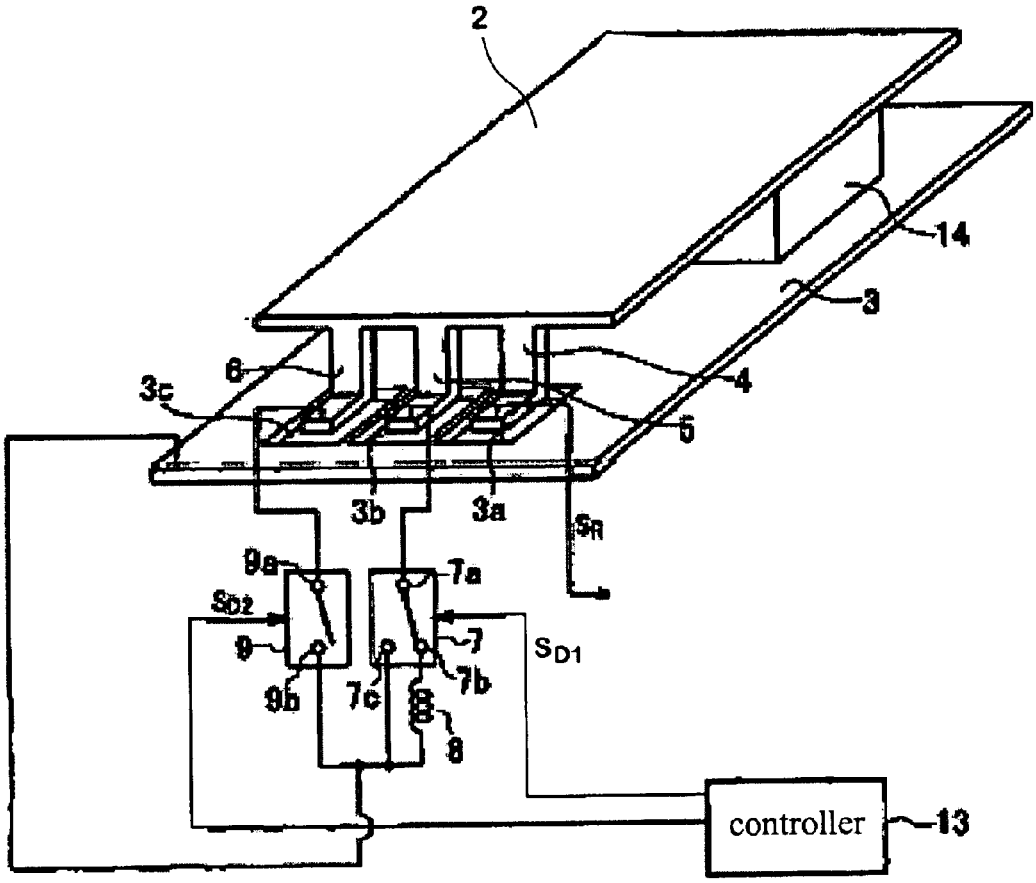
Fig. 1 PRIOR ART
FIG. 1 shows an example of a adjustable planar antenna according to the prior art.
Figure 8:
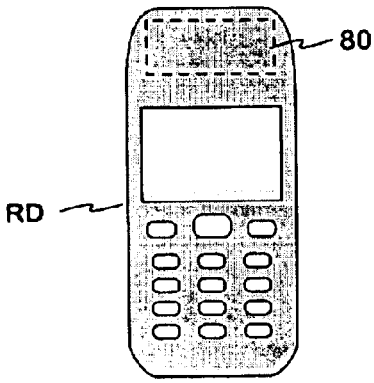
FIG. 8 shows an example of a radio device provided with an antenna according to the invention.

FIG. 8 shows a radio device RD including an adjustable planar antenna 80 according to the invention.

Prefixes "lower" and "upper" as well as words "under", "vertical" and "below" refer in this description and in the claims to the antenna positions depicted in the figures, and are not associated with the operating position of the device.

Above has been described examples of an adjustable planar antenna according to the invention. Therefrom it is noticed that a parasitic element can be arranged in such a part of the antenna structure, which is needed in any case. When the element furthermore is strip-like, it does neither make the structure bigger nor more complicated. The examples also show that in dual-band antennas the displacement of operation bands can be limited either to the lower or the upper band, if desired. This limitation, as well as change of the operation bands on the whole, is determined by the place and the size of the strip conductor. The amount of the displacement of an operation band can be set by an additional impedance regardless of the type of antenna. The additional impedance can also be electrically controlled based on a capacitance diode. The shape and the place of the parasitic element can vary greatly. Equally the basic structure of the antenna can deviate from those presented in the examples. For example, the antenna can be ceramic, in which case also the parasitic element is a part of the conductive coating of the ceramic block. On a ceramic block there can be a layer formed by glazing, which layer isolates the antenna's radiating elements from the parasitic element. The inventional idea can be applied in different ways within the scope defined by the independent claim 1.

What is claimed is:

1. An adjustable planar antenna comprising a ground plane, a radiating plane with a dielectric support part, a feed conductor of the antenna, a short conductor between said planes and a switch for changing at least one resonance frequency of the antenna, the planar antenna further comprising a parasitic conductive element, which is attached to said dielectric support part and galvanically connected to a first terminal of said switch, a second terminal of the switch having a coupling to the ground plane.

2. A planar antenna according to claim 1, said parasitic conductive element being a strip conductor.

3. A planar antenna according to claim 2, where the radiating plane is a conductive layer on upper surface of an antenna circuit board, and the dielectric support part is dielectric layer of the antenna circuit board, and said strip conductor is on lower surface of an antenna circuit board.

4. A planar antenna according to claim 3, having at least first and second radiating element which resonates in different operation bands, said strip conductor being in vertical direction by its whole area located by the first radiating element.

5. A planar antenna according to claim 3, having at least first and second radiating element which resonates in different operation bands, a first part of said strip conductor being in vertical direction located by the first radiating element and a second part of said strip conductor being in vertical direction located by the second radiating element.

6. A planar antenna according to claim 5, the second radiating element being a slot radiator.

7. A planar antenna according to claim 2, said dielectric support part being a support frame, which holds the radiating plane at certain distance from the ground plane, and said strip conductor being located on a vertical surface of said support frame.

8. A planar antenna according to claim 7, the radiating element being a separate metal sheet.

9. A planar antenna according to claim 7, the radiating element being a conductive layer on the upper surface of the antenna circuit board.

10. A planar antenna according to claim 1, said coupling of the second terminal of the switch to the ground plane being galvanic.

11. A planar antenna according to claim 1, said coupling of the second terminal of the switch to the ground plane being reactive for setting a displacement of a resonance frequency of the antenna.

12. A radio device having an adjustable planar antenna, which comprises a ground plane, a radiating plane with a dielectric support part, a feed conductor of the antenna, a short conductor between said planes and a switch for changing at least one resonance frequency of the antenna, the planar antenna further comprising a parasitic conductive element, which is attached to said dielectric support part and galvanically connected to a first terminal of said switch, a second terminal of the switch having a coupling to the ground plane.

* * * * *